US012752392B2

(12) United States Patent
Yamaguchi

(10) Patent No.: US 12,752,392 B2
(45) Date of Patent: Oct. 6, 2026

(54) GRINDING APPARATUS AND GRINDING METHOD

(71) Applicant: DISCO CORPORATION, Tokyo (JP)

(72) Inventor: Takashi Yamaguchi, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 287 days.

(21) Appl. No.: 18/391,950

(22) Filed: Dec. 21, 2023

(65) Prior Publication Data

US 2024/0238938 A1 Jul. 18, 2024

(30) Foreign Application Priority Data

Jan. 17, 2023 (JP) ..... 2023-005257

(51) Int. Cl.

| | |
|---|---|
| ***B24B 41/00*** | (2006.01) |
| ***B24B 7/22*** | (2006.01) |
| ***B24B 27/00*** | (2006.01) |
| ***B24B 27/02*** | (2006.01) |
| ***B24B 41/06*** | (2012.01) |
| ***B24B 45/00*** | (2006.01) |
| ***B24B 47/10*** | (2006.01) |
| ***B24B 49/00*** | (2012.01) |
| ***B24B 51/00*** | (2006.01) |

(52) U.S. Cl.

CPC ..... *B24B 41/005* (2013.01); *B24B 41/068* (2013.01); *B24B 51/00* (2013.01)

(58) Field of Classification Search

CPC ... B24B 7/228; B24B 27/0076; B24B 37/005; B24B 27/0069; B24B 19/02; B24B 27/0046; B24B 27/0023; B24B 41/005; B24B 41/047; B24B 41/068; B24B 7/04; B24B 1/00; B24B 27/0061; B24B 41/061; B24B 49/00; B24B 49/04; B24B 5/045; B24B 5/307; B24B 51/00; B24B 27/02; B24B 45/006; B24B 47/10; H10P 52/00; H10P 90/123; H10P 72/0428; H10P 72/0604; G01B 11/06; G01B 2210/48; G01B 5/06

See application file for complete search history.

(56) References Cited

U.S. PATENT DOCUMENTS 6,332,834 B1 * 12/2001 Nukui ..... B24B 9/065 451/8

FOREIGN PATENT DOCUMENTS

JP 2014124690 A 7/2014

* cited by examiner

*Primary Examiner* — Eric J Zamora Alvarez

(74) *Attorney, Agent, or Firm* — Greer, Burns & Crain, Ltd

(57) ABSTRACT

Provided is a grinding apparatus including a holding unit that holds a workpiece by a chuck table, a grinding unit, a transporting mechanism that has a holding part capable of holding the workpiece, a first table that holds the workpiece to be loaded onto the holding unit, a second table that holds the workpiece having been unloaded from the holding unit, and a controller. When the controller determines that replacement of a grinding wheel is necessary in a state in which all of the holding unit, the first table, and the second table are holding workpieces, the controller makes the holding part of the transporting mechanism hold the workpiece held by the holding unit.

12 Claims, 3 Drawing Sheets

GRINDING APPARATUS AND GRINDING METHOD

BACKGROUND OF THE INVENTION

Field of the Invention

The present invention relates to a grinding apparatus and a grinding method for grinding a workpiece.

Description of the Related Art

A workpiece such as a wafer on which a plurality of devices such as integrated circuits (ICs) and large-scale integration circuits (LSIs) are formed is processed in such a manner that an undersurface of the workpiece is ground by a grinding apparatus to have a predetermined thickness. Thereafter, a dividing apparatus such as a dicing apparatus divides the workpiece into individual device chips, which are used in electronic equipment such as mobile telephones or personal computers.

As an example of the grinding apparatus, a grinding apparatus described in JP 2014-124690A is known. JP 2014-124690A describes a grinding apparatus that grinds an upper surface of a wafer by a grinding unit while supplying grinding water to the upper surface of the wafer, the grinding unit including a grinding wheel having grinding stones annularly arranged thereon.

SUMMARY OF THE INVENTION

When the grinding apparatus grinds the workpiece, the grinding stones of the grinding wheel are appropriately worn by contact with the workpiece, thereby stabilizing conditions of the grinding stones. In such a grinding apparatus, generally, a controller that controls the grinding apparatus calculates a remaining amount of distal end portions of the grinding stones (hereinafter, a cutting edge remaining amount). In a case where this cutting edge remaining amount becomes equal to or less than a predetermined length, wheel replacement is performed.

For example, the grinding apparatus sequentially transports workpieces from a cassette that houses a plurality of workpieces, and successively grinds the workpieces. Then, in a case where the cutting edge remaining amount of the grinding wheel becomes equal to or less than the predetermined length during such successive processing operations of the grinding apparatus, the processing operations are interrupted in order to perform the wheel replacement.

Incidentally, when the replacement of the grinding wheel is to be performed, if there is a workpiece on a chuck table disposed directly below the grinding wheel to be replaced, the grinding wheel itself, dust occurring at the time of the replacement of the grinding wheel, or the like may fall onto the workpiece.

To avoid such a situation, the grinding apparatus temporarily collects and retracts the workpiece present on the chuck table into the cassette. Then, after the grinding wheel is replaced, the grinding apparatus transports the retreated workpiece from the cassette to the chuck table again and places the workpiece back into its original position.

As described above, at the time of the replacement of the grinding wheel, it takes time to transport the workpiece present on the chuck table to the cassette in order to temporarily retract the workpiece, and it takes time to transport the workpiece from the cassette to the chuck table again after the replacement of the grinding wheel. Consequently, a practical operating time of the grinding apparatus is decreased.

Accordingly, it is an object of the present invention to provide a grinding apparatus that makes it possible to replace a grinding wheel in the grinding apparatus for sequentially processing a plurality of workpieces, while suppressing a decrease in practical operating time of the grinding apparatus.

In accordance with an aspect of the present invention, there is provided a grinding apparatus for sequentially grinding a plurality of workpieces, the grinding apparatus including a holding unit that has a chuck table and holds a workpiece by the chuck table, a grinding unit that has a spindle fitted with a grinding wheel and grinds, by the grinding wheel, the workpiece held by the holding unit, a transporting mechanism that has a holding part capable of holding the workpiece, and loads the workpiece onto the holding unit and unloads the workpiece from the holding unit, a first table that holds the workpiece to be loaded onto the holding unit, a second table that holds the workpiece having been unloaded from the holding unit, and a controller that includes a processing device and a storage device and is capable of controlling an operation of the transporting mechanism according to a program stored in the storage device. The controller makes a transition to a state in which replacement of the grinding wheel is possible, by performing, according to the program, a step of determining whether or not the replacement of the grinding wheel fitted to the grinding unit is necessary in a state in which all of the holding unit, the first table, and the second table are holding the workpieces, and a step of making the holding part of the transporting mechanism hold the workpiece held by the holding unit, when it is determined that the replacement of the grinding wheel is necessary in the step of determining whether or not the replacement of the grinding wheel is necessary.

Preferably, in the step of determining whether or not the replacement of the grinding wheel is necessary, the controller determines whether or not the replacement of the grinding wheel is necessary on the basis of a cutting edge remaining amount of the grinding wheel.

Preferably, the controller further performs, according to the program, a step of making the holding unit hold the workpiece held by the holding part of the transporting mechanism, after the grinding wheel is replaced in the state in which the replacement of the grinding wheel is possible.

Preferably, the holding unit has a plurality of chuck tables.

In accordance with another aspect of the present invention, there is provided a grinding method for sequentially grinding a plurality of workpieces by using a grinding apparatus, the grinding apparatus including a holding unit that has a chuck table and holds a workpiece by the chuck table, a grinding unit that has a spindle fitted with a grinding wheel and grinds, by the grinding wheel, the workpiece held by the holding unit, a transporting mechanism that has a holding part capable of holding the workpiece, and loads the workpiece onto the holding unit and unloads the workpiece from the holding unit, a first table that holds the workpiece to be loaded onto the holding unit, and a second table that holds the workpiece having been unloaded from the holding unit. The grinding method includes a step of grinding, by the grinding wheel, a first workpiece held by the holding unit, a step of, after the first workpiece is ground by the grinding wheel, transporting the first workpiece held by the holding unit to the second table by the transporting mechanism, transporting a second workpiece held on the first table to the holding unit by the transporting mechanism, and transporting a third workpiece to the first table by the transporting mechanism, a step of determining whether or not replacement of the grinding wheel fitted to the grinding unit is necessary in a state in which the holding unit is holding the second workpiece, the second table is holding the first workpiece, and the first table is holding the third workpiece, and a step of making the holding part of the transporting mechanism hold the second workpiece held by the holding unit, when it is determined that the replacement of the grinding wheel of the grinding unit is necessary in the step of determining whether or not the replacement of the grinding wheel is necessary.

Preferably, the step of determining whether or not the replacement of the grinding wheel is necessary determines whether or not the replacement of the grinding wheel is necessary on the basis of a cutting edge remaining amount of the grinding wheel.

Preferably, the grinding method further includes a step of making the holding unit hold the second workpiece held by the holding part of the transporting mechanism, after the grinding wheel is replaced in a state in which the replacement of the grinding wheel is possible.

Preferably, the holding unit has a plurality of chuck tables.

The grinding apparatus according to one aspect of the present invention makes the holding part of the transporting mechanism hold the workpiece held by the holding unit, when the grinding wheel is to be replaced. It is thus possible to reduce the time taken to transport the workpiece from the holding unit to another table or the like and the time taken to transport the workpiece from the other table or the like to the holding unit again after the replacement of the grinding wheel. As a result, it is possible to provide a grinding apparatus that makes it possible to replace the grinding wheel while suppressing a decrease in practical operating time of the grinding apparatus.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
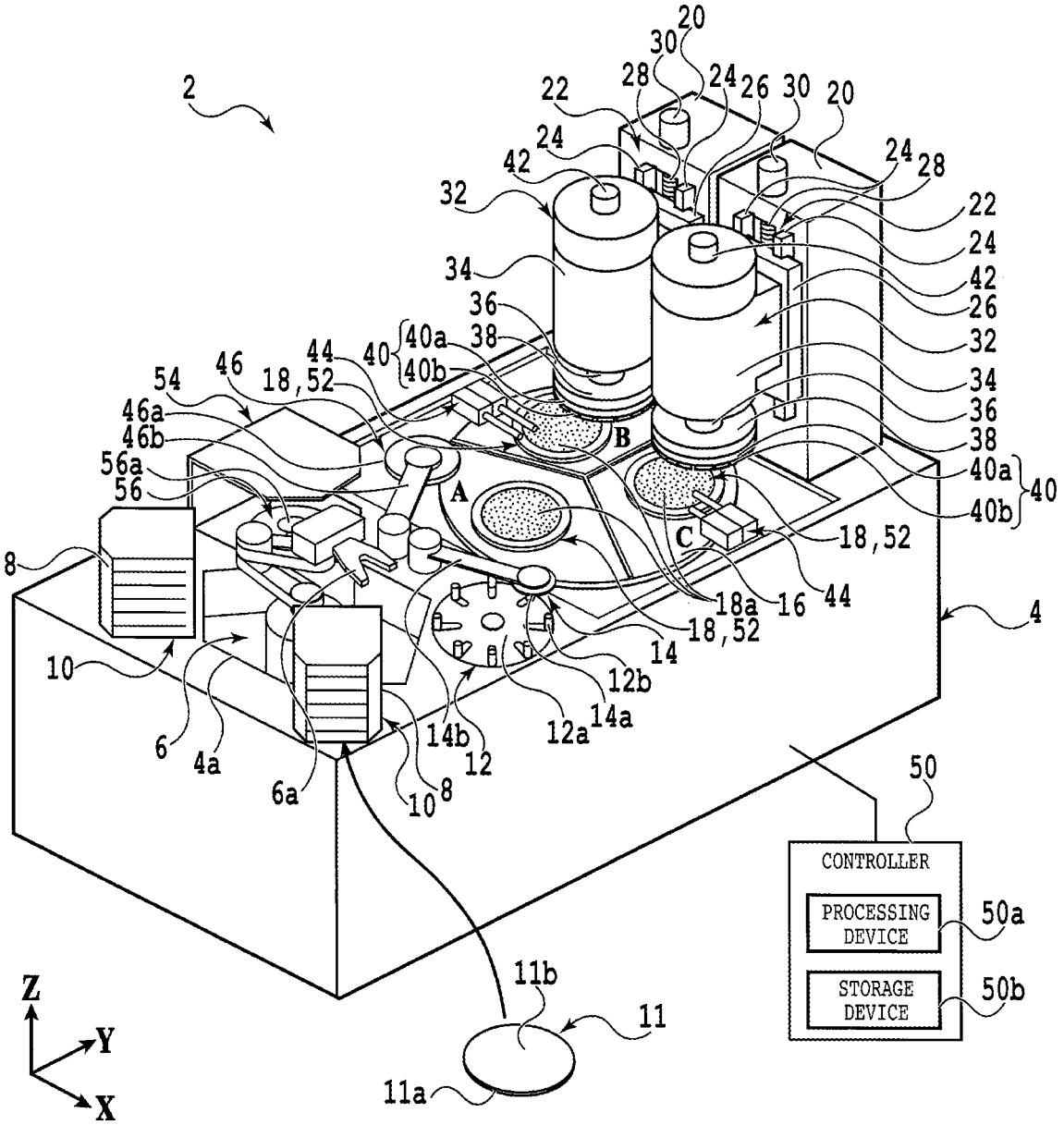
FIG. 1 is a perspective view schematically illustrating part of a grinding apparatus according to a present embodiment.

An embodiment of the present invention will hereinafter be described with reference to the accompanying drawings. FIG. 1 is a perspective view schematically illustrating part of a grinding apparatus 2 according to the present embodiment. Incidentally, in FIG. 1, some of elements constituting the grinding apparatus 2 are represented by functional blocks. In addition, an X-axis (axis along a left-right direction of the apparatus), a Y-axis (axis along a front-rear direction of the apparatus), and a Z-axis (axis along an upward-downward direction of the apparatus) used in the following description are perpendicular to one another.

As illustrated in FIG. 1, the grinding apparatus 2 includes a base 4 that supports various elements constituting the grinding apparatus 2. A front end side of an upper surface of the base 4 is provided with a housing space 4*a* in a recessed shape whose upper end opens to the upper surface of the base 4. A first transporting mechanism (transporting mechanism) 6 used to transport a workpiece 11 in a plate shape is housed within the housing space 4*a*. The first transporting mechanism 6 is typically a robot arm having a plurality of joints. The first transporting mechanism 6 has a holding pad (holding part) 6*a* that holds the workpiece 11. The first transporting mechanism 6 can not only transport the workpiece 11 but also vertically invert the workpiece 11.

The workpiece 11 is, for example, a disk-shaped wafer formed of a semiconductor material such as silicon. That is, the workpiece 11 has a circular top surface 11*a* and a circular undersurface 11*b* that is on a side opposite to the top surface 11*a*. The top surface 11*a* side of the workpiece 11 is, for example, demarcated into a plurality of small regions by a plurality of streets (planned dividing lines) that intersect each other. A device such as an IC is formed in each of the small regions.

The grinding apparatus 2 according to the present embodiment is, for example, used in grinding the undersurface 11*b* side of the workpiece 11. Incidentally, in grinding the undersurface 11*b* side of the workpiece 11, a protective member (not illustrated) formed of a material such as resin is preferably affixed to the top surface 11*a* side of the workpiece 11. When the protective member is affixed to the top surface 11*a* side of the workpiece 11, an impact applied to the top surface 11*a* side at the time of the grinding of the undersurface 11*b* side is alleviated, and the devices and the like on the workpiece 11 are protected.

In addition, in the present embodiment, a disk-shaped wafer formed of a semiconductor material such as silicon is used as the workpiece 11. However, the material, shape, structure, size, and the like of the workpiece 11 are not limited to this mode. For example, a substrate formed of a material such as another semiconductor, a ceramic, resin, or metal can be used as the workpiece 11. Similarly, the kind, quantity, shape, structure, size, arrangement, and the like of the devices are not limited to the above-described mode either. No devices may be formed on the workpiece 11.

As illustrated in FIG. 1, two cassette mounting regions 10 on which cassettes 8 capable of housing a plurality of workpieces 11 are mounted are provided obliquely forward of the housing space 4*a*. A position adjusting mechanism 12 for adjusting the position of the workpiece 11 is provided obliquely rearward of the housing space 4*a*.

The position adjusting mechanism 12 includes a disk-shaped position adjustment table (first table) 12*a* having a diameter smaller than that of the workpiece 11, and a plurality of pins 12*b* that are arranged on the periphery of the position adjustment table 12*a*.

When the plurality of pins 12*b* are moved along a radial direction of the position adjustment table 12*a*, the center of the workpiece 11 that has been unloaded from the cassette 8 by the first transporting mechanism 6 and has been placed on the position adjustment table 12*a* is, for example, set to a predetermined position in a direction along the X-axis and a direction along the Y-axis. Incidentally, the workpiece 11 is placed on the position adjustment table 12*a* in such a manner that a grinding target surface (undersurface 11*b* in the present embodiment) of the workpiece 11 is exposed upward.

A second transporting mechanism (transporting mechanism) 14 that holds the workpiece 11 and transports the workpiece 11 rearward is provided on a side of the position adjusting mechanism 12. The second transporting mechanism 14 includes, for example, an arm 14*b* and a holding pad (holding part) 14*a* that is connected to a distal end portion of the arm 14*b* and is capable of holding an upper surface (grinding target surface) side of the workpiece 11 under suction. By swinging the holding pad 14*a* by the arm 14*b*, the second transporting mechanism 14 transports rearward the workpiece 11 whose position has been adjusted by the position adjusting mechanism 12.

A turntable 16 is provided in the rear of the second transporting mechanism 14. The turntable 16 is connected to a rotational driving source (not illustrated) such as a motor. The turntable 16 is rotated about a rotational axis substantially parallel with the Z-axis by the power of the rotational driving source. On an upper surface of the turntable 16, three sets of disk-shaped chuck tables 18 constituting a holding unit 52 that holds the workpiece 11 are provided at substantially equal angular intervals along a circumferential direction of the turntable 16. However, the number, arrangement, and the like of the chuck tables 18 included in the holding unit 52 are not limited to this mode.

Each of the chuck tables 18 includes, for example, a disk-shaped frame body formed of a material such as a ceramic. An upper portion of the frame body is provided with a recessed portion whose upper end circularly opens to an upper surface of the frame body. A holding plate formed of a material such as a ceramic in the form of a porous disk is fixed to this recessed portion.

An upper surface (holding surface) 18*a* of the holding plate is, for example, formed in a shape corresponding to the side surface of a circular cone and functions as a holding surface that holds the workpiece 11. Incidentally, a difference in height (height difference) between the center of the upper surface 18*a* of the holding plate which center corresponds to the vertex of the circular cone and an outer circumferential edge of the upper surface 18*a* of the holding plate is approximately 10 to 30 μm.

A lower surface side of the holding plate is connected to a suction source such as an ejector (not illustrated) via a flow passage provided within the frame body, a valve disposed outside the frame body, and the like. Therefore, when the valve is opened and a negative pressure of the suction source acts in a state in which the workpiece 11 or the like is in contact with the upper surface 18*a* of the holding plate, the workpiece 11 is sucked by the chuck table 18. That is, the workpiece 11 is held by the holding surface of the chuck table 18.

Each chuck table 18 is connected to a rotational driving source (not illustrated) such as a motor. Each chuck table 18 is rotated by the power of the rotational driving source about a rotational axis substantially parallel with the Z-axis or a rotational axis slightly inclined with respect to the Z-axis. Incidentally, each chuck table 18 is supported by the turntable 16 via an angle adjusting mechanism (not illustrated), and the angle of the rotational axis of each chuck table 18 is adjusted by this angle adjusting mechanism.

The rotation of the turntable 16 moves each chuck table 18 in order of, for example, a loading and unloading region A adjacent to the second transporting mechanism 14, a rough grinding region B in the rear of the loading and unloading region A, a finish grinding region C on a side of the rough grinding region B, and the loading and unloading region A. The second transporting mechanism 14 transports the workpiece 11 held by the holding pad from the position adjustment table 12*a* of the position adjusting mechanism 12 to the chuck table 18 disposed in the loading and unloading region A.

As illustrated in FIG. 1, a columnar supporting structure 20 is provided in the rear of each of the rough grinding region B and the finish grinding region C (that is, in the rear of the turntable 16). A Z-axis moving mechanism 22 is provided on a front surface side of each supporting structure 20. Each Z-axis moving mechanism 22 includes a pair of guide rails 24 whose longitudinal direction is substantially parallel with the Z-axis. A moving plate 26 is attached in a slidable manner to the guide rails 24.

A rear surface side (undersurface side) of each moving plate 26 is provided with a nut portion (not illustrated) constituting a ball screw. A threaded shaft 28 substantially parallel with the guide rails 24 is coupled in a rotatable manner to the nut portion. A rotational driving source 30 such as a motor is connected to one end portion of each threaded shaft 28. When the threaded shaft 28 is rotated by the rotational driving source 30, the moving plate 26 moves along the guide rails 24.

A front surface (surface) of each moving plate 26 supports a grinding unit 32. Each grinding unit 32 includes a spindle housing 34 fixed to the moving plate 26. A spindle 36 having a rotational axis parallel with the Z-axis or an axis slightly inclined with respect to the Z-axis is housed in each spindle housing 34 in such a manner as to be rotatable about the axis.

A lower end portion of each spindle 36 is exposed from a lower end surface of the spindle housing 34. A disk-shaped mount 38 is fixed to this lower end portion. An outer edge portion of each mount 38, for example, is provided with a plurality of holes (not illustrated) that penetrate the mount 38 in a thickness direction. A bolt (not illustrated) as a fixture is inserted into each of the holes.

A grinding wheel 40 for rough grinding is attached by the bolts to a lower surface of the mount 38 of the grinding unit 32 on the rough grinding region B side. That is, the grinding wheel 40 for rough grinding is fitted to the spindle 36 on the rough grinding region B side. In addition, an upper portion of the spindle housing 34 of the grinding unit 32 on the rough grinding region B side is provided with a rotational driving source 42 such as a motor that is connected to an upper end side of the spindle 36. The power of the rotational driving source 42 rotates the grinding wheel 40 for rough grinding together with the spindle 36.

Meanwhile, a grinding wheel 40 for finish grinding is attached by the bolts to a lower surface of the mount 38 of the grinding unit 32 on the finish grinding region C side. That is, the grinding wheel 40 for finish grinding is fitted to the spindle 36 on the finish grinding region C side. In addition, an upper portion of the spindle housing 34 of the grinding unit 32 on the finish grinding region C side is provided with a rotational driving source 42 such as a motor that is connected to an upper end side of the spindle 36. The power of the rotational driving source 42 rotates the grinding wheel 40 for finish grinding together with the spindle 36.

Each grinding wheel 40 includes an annular wheel base 40*a* formed by using metal such as stainless steel or aluminum. A plurality of grinding stones 40*b* formed by dispersing abrasive grains of diamond or the like in a binder such as a vitrified binder or a resinoid are fixed to a lower surface of the wheel base 40*a* in such a manner as to be annularly arranged along a circumferential direction of the wheel base 40*a*.

Incidentally, an average particle diameter of the abrasive grains contained in the grinding stones 40*b* of the grinding wheel 40 for finish grinding is smaller than an average particle diameter of the abrasive grains contained in the grinding stones 40*b* of the grinding wheel 40 for rough grinding. Thus, the grinding wheel 40 suitable for rough grinding and the grinding wheel 40 suitable for finish grinding are realized. Specific sizes of the abrasive grains are set appropriately according to quality desired of the workpiece 11 to be obtained after being ground and the like.

A nozzle (not illustrated) that can supply a liquid (grinding liquid) such as pure water to a part where the workpiece 11 held on the chuck table 18 and the grinding stones 40*b* make contact with each other is disposed on a side of each grinding wheel 40. Incidentally, in place of the nozzle or in conjunction with the nozzle, a liquid supply port used to supply a liquid may be provided to the grinding wheel 40 or the like.

In addition, a thickness measuring instrument 44 used in measuring the thickness or the like of the workpiece 11 being ground is disposed on each of sides of the rough grinding region B and the finish grinding region C. The thickness measuring instrument 44 typically includes a first height gage capable of measuring the height of the upper surface of the frame body of the chuck table 18 and a second height gage capable of measuring the height of the upper surface of the workpiece 11 held on the chuck table 18. A difference between a measured value of the first height gage and a measured value of the second height gage is adopted as the thickness of the workpiece 11.

The workpiece 11 held on the chuck table 18 in the rough grinding region B has the upper surface side thereof ground by the grinding unit 32 on the rough grinding region B side described above. In addition, the workpiece 11 held on the chuck table 18 in the finish grinding region C has the upper surface side thereof ground by the grinding unit 32 on the finish grinding region C side described above.

That is, the chuck table 18 holding the workpiece 11 moves in order of the loading and unloading region A, the rough grinding region B, and the finish grinding region C, and hence, the rough grinding of the workpiece 11 and the finish grinding of the workpiece 11 after the rough grinding are successively performed. After the finish grinding of the workpiece 11 is completed, the chuck table 18 in the finish grinding region C is disposed in the loading and unloading region A again.

A third transporting mechanism (transporting mechanism) 46 that holds the workpiece 11 obtained after being ground and transports the workpiece 11 forward is provided at a position in front of the loading and unloading region A and on a side of the second transporting mechanism 14. The third transporting mechanism 46 includes an arm 46*b* and a holding pad (holding part) 46*a* that is connected to a distal end portion of the arm 46*b* and is capable of holding the upper surface (grinding target surface) side of the workpiece 11 under suction. By swinging the holding pad 46*a* by the arm 46*b*, the third transporting mechanism 46 transports forward the workpiece 11 obtained after being ground from the chuck table 18 in the loading and unloading region A.

A cleaning unit 54 that cleans the workpiece 11 unloaded by the third transporting mechanism 46 is provided on a side of the third transporting mechanism 46. The cleaning unit 54, for example, includes a spinner table (second table) 56 that rotates in a state of holding a lower surface side of the workpiece 11 by a holding part 56*a*, and a cleaning nozzle (not illustrated) that jets a cleaning fluid to the upper surface side of the workpiece 11 held by the holding part 56*a* of the spinner table 56.

The cleaning fluid used by the cleaning unit 54 is typically a mixed fluid (binary fluid) in which water and air are mixed with each other. Needless to say, water not mixed with air or the like may be used as the cleaning fluid. The workpiece 11 cleaned by the cleaning unit 54 is transported by the first transporting mechanism 6 to be, for example, housed in the cassette 8 from which the workpiece 11 has been transported.

A controller 50 is connected to each element of the grinding apparatus 2. The controller 50 is, for example, constituted by a computer including a processing device 50*a* and a storage device 50*b*. The controller 50 controls operations and the like of the respective elements of the grinding apparatus 2 described above such that the workpiece 11 is ground appropriately.

The processing device 50*a* is typically a central processing unit (CPU). The processing device 50*a* performs various kinds of processing necessary to control the above-described elements. The storage device 50*b* includes, for example, a main storage device such as a dynamic random access memory (DRAM) and an auxiliary storage device such as a hard disk drive or a flash memory. Functions of the controller 50 are, for example, implemented by the processing device 50*a* operating in accordance with software such as a program stored in the storage device 50*b*.

When the grinding apparatus 2 according to the present embodiment successively performs grinding of a plurality of workpieces 11, each of the plurality of workpieces 11 housed in the cassette 8 is transported in order of the position adjustment table 12*a*, the holding unit 52 (chuck table 18), and the spinner table 56.

That is, a workpiece 11 that is held by the holding unit 52 (chuck table 18) and whose grinding is completed is unloaded from the holding unit 52 (chuck table 18) and loaded onto the spinner table 56 by the third transporting mechanism 46. In addition, onto the holding unit 52 (chuck table 18) left after the workpiece 11 is unloaded, a workpiece 11 present on the position adjustment table 12*a* is loaded by the second transporting mechanism 14.

Further, onto the position adjustment table 12*a* left after the workpiece 11 is unloaded, a workpiece 11 housed in the cassette 8 is loaded by the first transporting mechanism 6. Thus, when the grinding of the plurality of workpieces 11 is successively performed, the position adjustment table 12*a*, the chuck table 18, and the spinner table 56 are in a state in which the workpieces 11 are placed thereon at all times.

Figure 2:
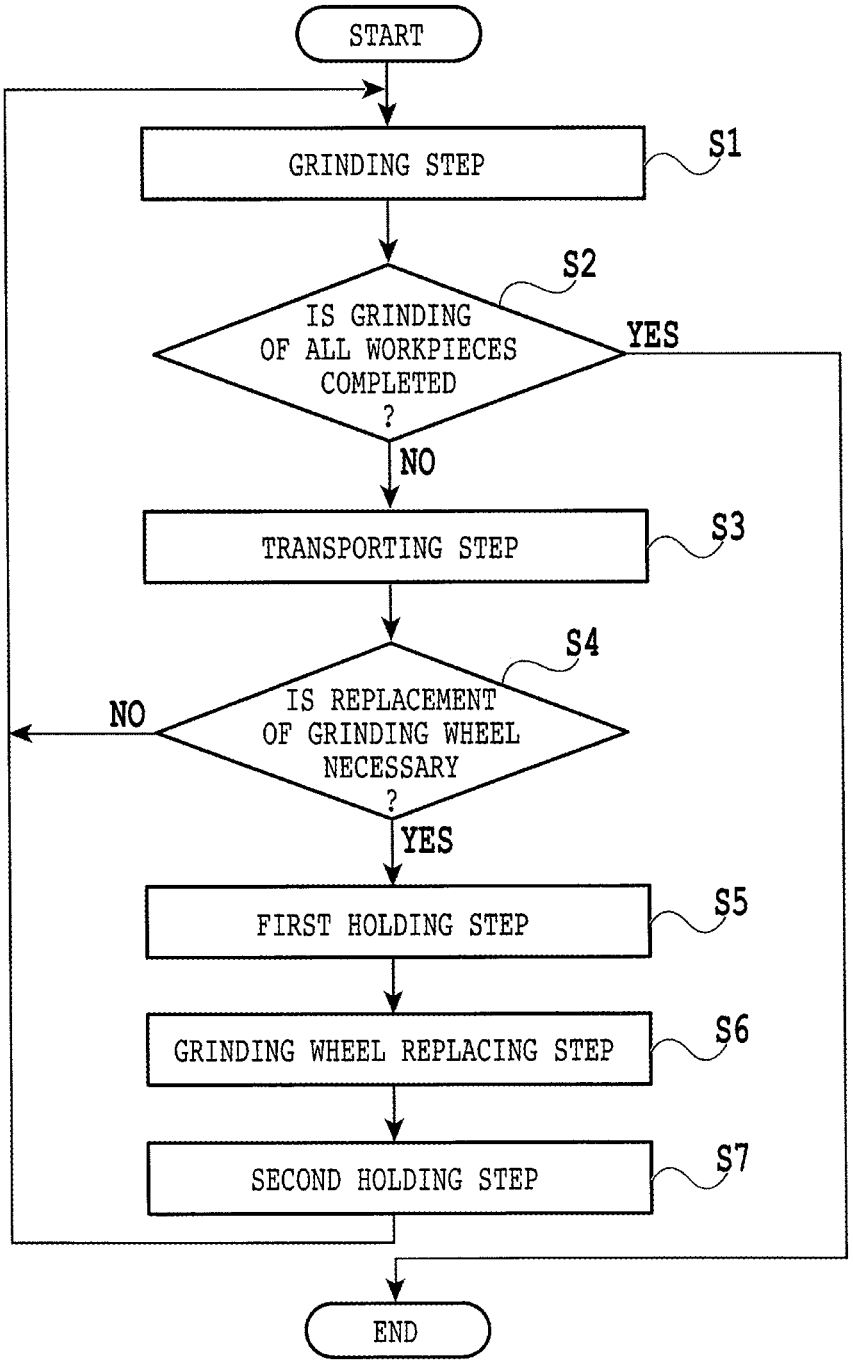
FIG. 2 is a flowchart illustrating a grinding method according to the present embodiment.

Next, description will be made of a processing procedure at the time of replacing a grinding wheel 40 in the grinding apparatus 2 according to the present embodiment described above. FIG. 2 is a flowchart illustrating a grinding method including the processing procedure at the time of replacing a grinding wheel 40. In this grinding method, a grinding step S1 grinds workpieces 11 held on the chuck tables 18 (chuck tables 18 present in the rough grinding region B and the finish grinding region C).

Then, after the grinding of the workpieces 11 is completed, the turntable 16 is rotated. Thus, the chuck table 18 present in the rough grinding region B moves to the finish grinding region C, the chuck table 18 present in the finish grinding region C moves to the loading and unloading region A, and the chuck table 18 present in the loading and unloading region A moves to the rough grinding region B. Then, the workpiece 11 that has been ground and is present in the loading and unloading region A is unloaded into the cleaning unit 54 by the third transporting mechanism 46 and is cleaned by the cleaning unit 54.

After the grinding of the workpieces 11 is started in the grinding step S1, for example, the controller 50 performs a step S2 that determines whether or not the grinding of all of the grinding target workpieces 11 housed in the cassette 8 is completed, according to the program stored in the storage device 50*b*. When it is determined that the grinding of all of the workpieces 11 is completed (when a determination in S2 is "Yes"), for example, the ground workpiece 11 cleaned by the cleaning unit 54 is housed into the cassette 8 by the first transporting mechanism 6. The present flow is then ended.

When it is determined that the grinding of all of the workpieces 11 is not completed (when the determination in S2 is "No"), on the other hand, performed is a transporting step S3 that transports a workpiece 11 to be ground next to the chuck table 18. The ground workpiece 11 has already been unloaded onto the spinner table 56, and the chuck table 18 in the loading and unloading region A is empty.

Accordingly, the second transporting mechanism 14 transports a workpiece 11 present on the position adjustment table 12*a* to the empty chuck table 18 in the loading and unloading region A. Then, the first transporting mechanism 6 transports a workpiece 11 housed in the cassette 8 to the position adjustment table 12*a*.

Next, the controller 50 performs a step S4 that determines whether or not the replacement of the grinding wheel 40 is necessary, according to the program stored in the storage device 50*b*. The determination of whether or not the replacement of the grinding wheel 40 is necessary is made on the basis of a cutting edge remaining amount of the grinding stones 40*b*, for example. In order to maintain processing quality, grinding is preferably performed by the grinding stones 40*b* having a cutting edge in a predetermined remaining amount or more.

The cutting edge remaining amount can be recognized from a wear amount of the grinding stones 40*b* calculated from a descending amount of the grinding unit 32 and the thickness of the workpiece 11. Specifically, when the workpiece 11 is to be ground, the grinding unit 32 descends in such a manner that lower surfaces of the grinding stones 40*b* come into contact with the grinding target surface of the workpiece 11. The position of the lower surfaces of the grinding stones 40*b* is calculated from the descending amount at this time. Meanwhile, the position of the top surface of the workpiece 11 is calculated from the thickness of the workpiece 11. A difference between the position of the lower surfaces of the grinding stones 40*b* and the position of the top surface of the workpiece 11 is the wear amount of the grinding stones 40*b*.

In the present embodiment, a threshold value serving as a reference at the time of determining the cutting edge remaining amount of the grinding stones 40*b* is set, and is stored in the storage device 50*b* of the controller 50. This threshold value is, for example, a value corresponding to a lower limit of the cutting edge remaining amount below which the processing quality cannot be maintained. When the cutting edge remaining amount is equal to or more than the threshold value (when the determination in S4 is "No"), the grinding wheel 40 is not replaced, and the grinding step S1 is performed again.

When the cutting edge remaining amount is less than the threshold value (when the determination in S4 is "Yes"), on the other hand, the controller 50 makes a transition to a state in which the replacement of the grinding wheel 40 can be performed. Specifically, the processing device 50*a* of the controller 50 performs a first holding step S5 that temporarily retracts the workpiece 11 from the holding unit 52 by making the holding part of the second transporting mechanism 14 or the third transporting mechanism 46 hold the workpiece 11.

Figure 3:
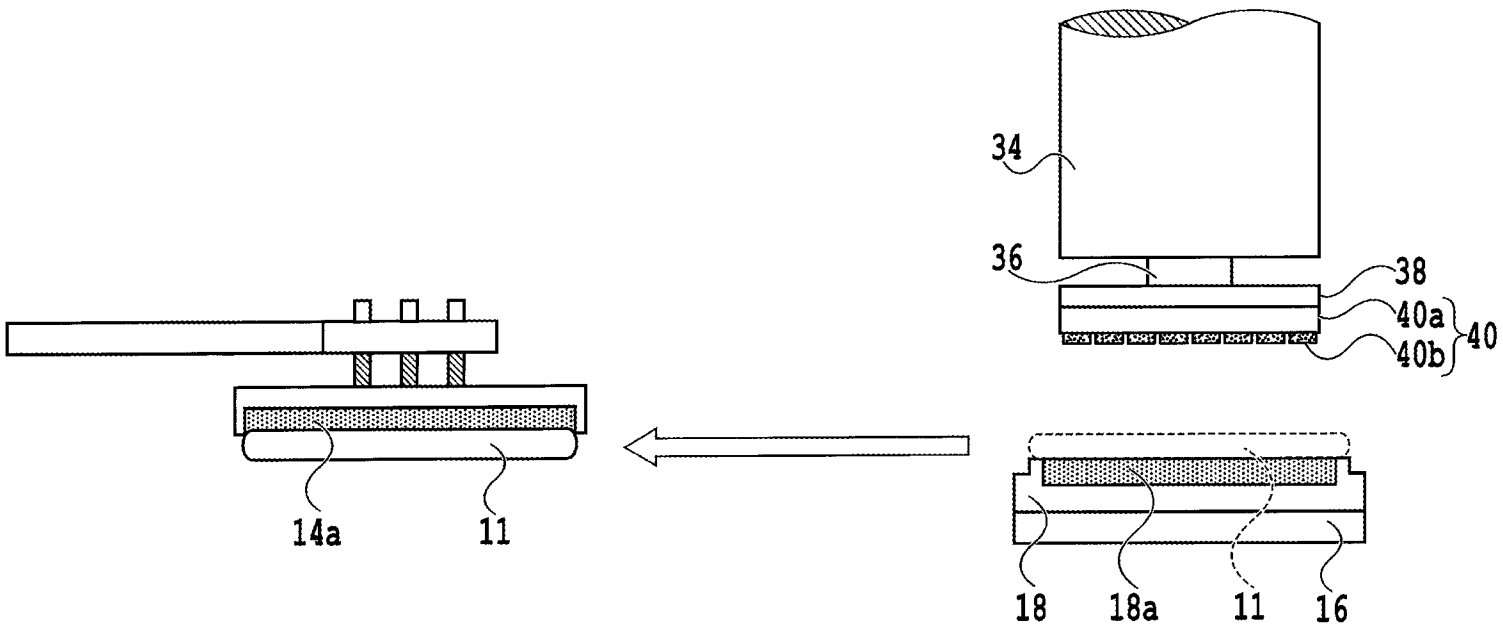
FIG. 3 is a sectional view schematically illustrating part of a transporting mechanism, a holding unit, and a grinding unit in a first holding step in FIG. 2.

In a case where the grinding wheel 40 present in the finish grinding region C is to be replaced, for example, the turntable 16 is rotated, and the workpiece 11 present on the chuck table 18 in the finish grinding region C is moved to the loading and unloading region A and is held by the second transporting mechanism 14. FIG. 3 is a sectional view schematically illustrating part of the second transporting mechanism 14, the holding unit 52, and the grinding unit 32 in the first holding step S5 in FIG. 2. Incidentally, while FIG. 3 illustrates a mode in which the workpiece 11 is held by the holding pad 14*a* of the second transporting mechanism 14, the workpiece 11 may be held by the holding pad 46*a* of the third transporting mechanism 46.

As illustrated in FIG. 3, while the workpiece 11 is held by the holding pad 14*a* of the second transporting mechanism 14, an operator, for example, performs a grinding wheel replacing step S6 of replacing the grinding wheel 40, so that the grinding wheel 40 is replaced. Then, after the replacement of the grinding wheel 40 is completed, the workpiece 11 held by the holding part of the second transporting mechanism 14 or the third transporting mechanism 46 is again held by the chuck table 18 in the loading and unloading region A in a second holding step S7. Thereafter, the turntable 16 is rotated, and the workpiece 11 present on the chuck table 18 in the loading and unloading region A is thus moved to the finish grinding region C.

After the second holding step S7, the grinding step S1 of grinding the workpieces 11 is performed again. Then, the other steps are similarly repeated.

According to the present embodiment, when the grinding wheel 40 is replaced, the holding part of the second transporting mechanism 14 or the third transporting mechanism 46 is made to hold the workpiece 11 held by the holding unit 52. It is thus possible to reduce the time taken to transport the workpiece 11 to another table or the like that is temporarily empty and the time taken to transport the workpiece 11 from the other table or the like to the holding unit 52 again after the replacement of the grinding wheel 40. As a result, it is possible to provide a grinding apparatus that makes it possible to replace a grinding wheel while suppressing a decrease in practical operating time of the grinding apparatus.

FIG. 1 illustrates an example in which the table (first table) that holds a workpiece 11 to be loaded onto the holding unit 52 is the position adjustment table 12*a*, and the table (second table) that holds the workpiece 11 having been unloaded from the holding unit 52 is the spinner table 56 of the cleaning unit 54. However, the first table and the second table are not limited to these. It suffices for the first table to be a table that holds a workpiece 11 to be loaded onto the holding unit 52, and it suffices for the second table to be a table that holds the workpiece 11 having been unloaded from the holding unit 52. The first table and the second table may be tables of any units.

In addition, while FIG. 1 illustrates a configuration in the case of including the three chuck tables 18 in the holding unit 52, the number of chuck tables 18 is not limited to three and may be one, two, or four or more.

Further, the transporting mechanisms that load and unload the workpiece 11 onto and from the holding unit 52 are not limited to the second transporting mechanism 14 and the third transporting mechanism 46. The transporting mechanisms may be one transporting mechanism in which these transporting mechanisms are integral with each other, or may be divided into three or more transporting mechanisms.

Besides, structures, methods, and the like according to the foregoing embodiment can be modified and implemented as appropriate without departing from the objective scope of the present invention.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding apparatus for sequentially grinding a plurality of workpieces, the grinding apparatus comprising:

a holding unit that has a chuck table and holds a workpiece by the chuck table;

a grinding unit that has a spindle fitted with a grinding wheel and grinds, by the grinding wheel, the workpiece held by the holding unit;

a transporting mechanism that has a holding part capable of holding the workpiece, and loads the workpiece onto the holding unit and unloads the workpiece from the holding unit;

a first table that holds the workpiece to be loaded onto the holding unit;

a second table that holds the workpiece having been unloaded from the holding unit; and a controller that includes a processing device and a storage device and is capable of controlling an operation of the transporting mechanism according to a program stored in the storage device;

the controller making a transition to a state in which replacement of the grinding wheel is to be made, by performing, according to the program, a step of determining whether or not the replacement of the grinding wheel fitted to the grinding unit is necessary in a state in which the holding unit is holding a second workpiece, the second table is holding a first workpiece, and the first table is holding a third workpiece, and a step of making the holding part of the transporting mechanism hold the second workpiece held by the holding unit, when it is determined that the replacement of the grinding wheel is necessary in the step of determining whether or not the replacement of the grinding wheel is necessary.

2. The grinding apparatus according to claim 1, wherein, in the step of determining whether or not the replacement of the grinding wheel is necessary, the controller determines whether or not the replacement of the grinding wheel is necessary on a basis of a cutting edge remaining amount of the grinding wheel.

3. The grinding apparatus according to claim 2, wherein the controller further performs, according to the program, a step of making the holding unit hold the workpiece held by the holding part of the transporting mechanism, after the grinding wheel is replaced.

4. The grinding apparatus according to claim 2, wherein the holding unit has a plurality of chuck tables.

5. The grinding apparatus according to claim 1, wherein the controller further performs, according to the program, a step of making the holding unit hold the workpiece held by the holding part of the transporting mechanism, after the grinding wheel is replaced.

6. The grinding apparatus according to claim 1, wherein the holding unit has a plurality of chuck tables.

7. A grinding method for sequentially grinding a plurality of workpieces by using a grinding apparatus, the grinding apparatus including a holding unit that has a chuck table and holds a workpiece by the chuck table, a grinding unit that has a spindle fitted with a grinding wheel and grinds, by the grinding wheel, the workpiece held by the holding unit, a transporting mechanism that has a holding part capable of holding the workpiece, and loads the workpiece onto the holding unit and unloads the workpiece from the holding unit, a first table that holds the workpiece to be loaded onto the holding unit, and a second table that holds the workpiece having been unloaded from the holding unit, the grinding method comprising:

a step of grinding, by the grinding wheel, a first workpiece held by the holding unit;

a step of, after the first workpiece is ground by the grinding wheel, transporting the first workpiece held by the holding unit to the second table by the transporting mechanism, transporting a second workpiece held on the first table to the holding unit by the transporting mechanism, and transporting a third workpiece to the first table by the transporting mechanism;

a step of determining whether or not replacement of the grinding wheel fitted to the grinding unit is necessary in a state in which the holding unit is holding the second workpiece, the second table is holding the first workpiece, and the first table is holding the third workpiece; and a step of making the holding part of the transporting mechanism hold the second workpiece held by the holding unit, when it is determined that the replacement of the grinding wheel of the grinding unit is necessary in the step of determining whether or not the replacement of the grinding wheel is necessary.

8. The grinding method according to claim 7, wherein the step of determining whether or not the replacement of the grinding wheel is necessary determines whether or not the replacement of the grinding wheel is necessary on a basis of a cutting edge remaining amount of the grinding wheel.

9. The grinding method according to claim 8, further comprising:

a step of making the holding unit hold the second workpiece held by the holding part of the transporting mechanism, after the grinding wheel is replaced.

10. The grinding method according to claim 8, wherein the holding unit has a plurality of chuck tables.

11. The grinding method according to claim 7, further comprising:

a step of making the holding unit hold the second workpiece held by the holding part of the transporting mechanism, after the grinding wheel is replaced.

12. The grinding method according to claim 7, wherein the holding unit has a plurality of chuck tables.

* * * * *